US007431771B2

(12) United States Patent
Zeiffer et al.

(10) Patent No.: US 7,431,771 B2
(45) Date of Patent: Oct. 7, 2008

(54) APPARATUS AND METHOD FOR APPLYING A FOAMED COMPOSITION TO A DIMENSIONALLY UNSTABLE TRAVELING SUBSTRATE

(75) Inventors: Dieter F. Zeiffer, Iron Station, NC (US); Hermann A. Neupert, Belmont, NC (US)

(73) Assignee: Gaston Systems, Inc., Stanley, NC (US)

( * ) Notice: Subject to any disclaimer, the term of this patent is extended or adjusted under 35 U.S.C. 154(b) by 244 days.

(21) Appl. No.: 10/987,073

(22) Filed: Nov. 12, 2004

(65) Prior Publication Data

US 2006/0102071 A1 May 18, 2006

(51) Int. Cl.
*B05C 5/02* (2006.01)
*B05D 1/26* (2006.01)

(52) U.S. Cl. ..... 118/325; 118/304; 68/200; 68/202

(58) Field of Classification Search ..... 118/325, 118/304; 427/209, 211; 68/200, 202; 8/151; 28/167

See application file for complete search history.

(56) References Cited

U.S. PATENT DOCUMENTS

| | | | | |
|---|---|---|---|---|
| 2,114,618 | A | 4/1938 | Wallin | 91/68 |
| 2,992,627 | A | 7/1961 | Ring | 118/413 |
| 3,042,573 | A | 7/1962 | Roberts | 156/285 |
| 3,722,469 | A | 3/1973 | Bartley et al. | 118/414 |
| 3,832,427 | A | 8/1974 | Mutch | 264/39 |
| 3,969,780 | A | 7/1976 | Henderson | 8/149.1 |
| 4,016,831 | A | 4/1977 | James et al. | 118/415 |
| 4,023,526 | A | 5/1977 | Ashmus et al. | 118/410 |
| 4,061,001 | A | 12/1977 | Von der Eltz et al. | 68/200 |
| 4,062,989 | A | 12/1977 | Long | 427/176 |
| 4,064,891 | A | 12/1977 | Eberhardt | 137/98 |
| 4,072,775 | A | 2/1978 | James et al. | 427/373 |
| 4,089,296 | A | 5/1978 | Barchi | 118/413 |
| 4,159,354 | A | 6/1979 | Milnes et al. | 427/209 |
| 4,225,638 | A | 9/1980 | Waugh | 427/331 |
| 4,237,818 | A | 12/1980 | Clifford et al. | 118/410 |
| 4,239,821 | A | 12/1980 | McLean et al. | 427/358 |
| 4,292,918 | A | 10/1981 | Davis et al. | 118/33 |
| 4,297,860 | A | 11/1981 | Pacifici et al. | 68/200 |
| 4,299,591 | A | 11/1981 | Gregorian et al. | 8/477 |
| 4,305,169 | A | 12/1981 | Vidalis | 8/149 |
| 4,326,904 | A | 4/1982 | Eckert et al. | 156/85 |
| 4,343,835 | A | 8/1982 | Jones et al. | 427/209 |
| 4,349,930 | A | 9/1982 | Van Wersch et al. | 8/151 |
| 4,357,373 | A | 11/1982 | Cooper | 427/358 |
| 4,364,784 | A | 12/1982 | Van Wersch et al. | 156/78 |
| 4,384,867 | A | 5/1983 | Grüber | 8/477 |

(Continued)

*Primary Examiner*—Laura Edwards
(74) *Attorney, Agent, or Firm*—K&L Gates LLP

(57) ABSTRACT

An apparatus and method for applying a foamed composition to a traveling substrate that has a tendency to be dimensionally unstable. A pair of closely spaced driven guide rollers guides a traveling substrate with sufficient roller engagement and controlled tension to minimize dimensional distortion. A foam applicator with a substrate engaging foam dispensing nozzle face is positioned within the space between the rollers to deflect the substrate inwardly between the rollers. The face extends in close proximity to the rollers to minimize the free extent of travel of the substrate between the rollers and the nozzle face. Two pairs of guide rollers and two nozzles may be arranged for applying foamed composition to the opposite sides of the traveling substrate.

5 Claims, 4 Drawing Sheets

U.S. PATENT DOCUMENTS

| | | | | |
|---|---|---|---|---|
| 4,387,118 | A | 6/1983 | Shelton | 427/176 |
| 4,394,289 | A | 7/1983 | Brown et al. | 252/359 |
| 4,398,665 | A | 8/1983 | Bryant et al. | 239/193 |
| 4,402,200 | A | 9/1983 | Clifford et al. | 68/200 |
| 4,407,767 | A | 10/1983 | Seaborn | 264/40.1 |
| 4,408,995 | A | 10/1983 | Guth et al. | 8/477 |
| 4,420,510 | A | 12/1983 | Kunkel et al. | 427/208.2 |
| 4,431,429 | A | 2/1984 | Booth | 8/477 |
| 4,442,144 | A | 4/1984 | Pipkin | 427/355 |
| 4,444,104 | A | 4/1984 | Mitter | 101/119 |
| 4,463,467 | A | 8/1984 | Grüber et al. | 8/151 |
| 4,463,583 | A | 8/1984 | Krüger et al. | 68/205 R |
| 4,473,521 | A | 9/1984 | Tassone | 264/136 |
| 4,485,508 | A | 12/1984 | Otting | 8/151 |
| 4,490,428 | A | 12/1984 | Long | 428/110 |
| 4,500,039 | A | 2/1985 | Pacifici et al. | 239/193 |
| 4,501,771 | A | 2/1985 | Long | 427/176 |
| 4,502,304 | A | 3/1985 | Hopkins | 68/200 |
| 4,512,279 | A | 4/1985 | Damrau et al. | 118/411 |
| 4,521,362 | A | 6/1985 | Tassone | 264/136 |
| 4,528,214 | A | 7/1985 | Long et al. | 427/173 |
| 4,548,611 | A | 10/1985 | Paterson et al. | 8/477 |
| 4,548,837 | A | 10/1985 | Yoshino et al. | 427/209 |
| 4,557,218 | A | 12/1985 | Sievers | 118/612 |
| 4,562,097 | A | 12/1985 | Walter et al. | 427/209 |
| 4,565,715 | A | 1/1986 | Long | 427/176 |
| 4,569,107 | A | 2/1986 | Pomeroy | 28/184 |
| 4,576,112 | A | 3/1986 | Funger et al. | 118/415 |
| 4,581,254 | A | 4/1986 | Cunningham et al. | 427/244 |
| 4,582,660 | A | 4/1986 | Tassone | 264/136 |
| 4,622,243 | A | 11/1986 | Long | 427/176 |
| 4,624,213 | A | 11/1986 | Long et al. | 118/300 |
| 4,624,813 | A | 11/1986 | Long | 264/137 |
| 4,637,940 | A | 1/1987 | Long | 427/176 |
| 4,641,404 | A | 2/1987 | Seydel et al. | 28/178 |
| 4,644,900 | A | 2/1987 | Poterala | 118/670 |
| 4,655,056 | A | 4/1987 | Zeiffer | 68/205 R |
| 4,656,063 | A | 4/1987 | Long et al. | 427/420 |
| 4,661,399 | A | 4/1987 | Anderson, Jr. et al. | 428/246 |
| 4,711,792 | A | 12/1987 | Long | 427/176 |
| 4,741,924 | A | 5/1988 | Long et al. | 427/173 |
| 4,753,823 | A | 6/1988 | Long | 427/176 |
| 4,769,260 | A | 9/1988 | Long | 427/176 |
| 4,773,110 | A | 9/1988 | Hopkins | 8/151 |
| 4,792,252 | A | 12/1988 | Kremer et al. | 401/206 |
| 4,796,558 | A | 1/1989 | Chartrand et al. | 118/74 |
| 4,844,001 | A | 7/1989 | Jones | 118/24 |
| 4,943,451 | A | 7/1990 | Zimmer | 427/294 |
| 4,944,078 | A | 7/1990 | Nakade | 28/183 |
| 4,970,039 | A | 11/1990 | Long | 264/136 |
| 5,008,131 | A | 4/1991 | Bakhshi | 427/209 |
| 5,009,932 | A | 4/1991 | Klett et al. | 427/243 |
| 5,066,428 | A | 11/1991 | Manlowe et al. | 261/29 |
| 5,074,883 | A | 12/1991 | Wang | 8/115.6 |
| 5,089,296 | A | 2/1992 | Bafford et al. | 427/208 |
| 5,145,527 | A | 9/1992 | Clifford et al. | 118/411 |
| 5,165,261 | A | 11/1992 | Cho | 68/205 R |
| 5,202,077 | A | 4/1993 | Marco et al. | 264/504 |
| 5,219,620 | A | 6/1993 | Potter et al. | 427/434.2 |
| 5,277,041 | A | 1/1994 | Ahrweiler et al. | 68/205 R |
| 5,340,609 | A | 8/1994 | Arthur et al. | 429/244 |
| 5,367,982 | A | 11/1994 | DeMoore et al. | 118/46 |
| 5,403,622 | A | 4/1995 | Nishi et al. | 427/356 |
| 5,409,733 | A | 4/1995 | Boger et al. | 427/96 |
| 5,418,009 | A | 5/1995 | Raterman et al. | 427/207.1 |
| 5,429,840 | A | 7/1995 | Raterman et al. | 427/256 |
| 5,484,453 | A | 1/1996 | Baehr et al. | 8/111 |
| 5,505,995 | A | 4/1996 | Leonard | 427/348 |
| 5,524,828 | A | 6/1996 | Raterman et al. | 239/413 |
| 5,525,373 | A | 6/1996 | Chandler | 427/348 |
| 5,556,471 | A | 9/1996 | Boccagno et al. | 118/300 |
| 5,642,548 | A | 7/1997 | Osbourn | 8/152 |
| 5,657,520 | A | 8/1997 | Greenway et al. | 26/51 |
| 5,683,508 | A | 11/1997 | Bleiler et al. | 118/46 |
| 5,887,519 | A | 3/1999 | Zelko | 101/115 |
| 5,891,812 | A | 4/1999 | Honeycutt et al. | 442/118 |
| 6,395,088 | B1 | 5/2002 | Zeiffer | 118/410 |
| 6,432,202 | B1 | 8/2002 | Aurich | 118/420 |
| 6,814,806 | B2 | 11/2004 | Zeiffer et al. | 118/411 |
| 2002/0108568 | A1 | 8/2002 | Zeiffer | 118/663 |

APPARATUS AND METHOD FOR APPLYING A FOAMED COMPOSITION TO A DIMENSIONALLY UNSTABLE TRAVELING SUBSTRATE

FIELD OF THE PRESENT INVENTION

The present invention relates to an apparatus and method for applying a foamed composition to a traveling substrate, and, more particularly, to a traveling substrate that has a tendency to be dimensionally unstable.

BACKGROUND OF THE PRESENT INVENTION

In the application of compositions to traveling substrates, it is common to generate a foam that carries the composition and to apply the foamed composition from an applicator nozzle across the width of a traveling substrate. As the foam disintegrates on and into the substrate, the bulk of the composition remains on or in the substrate without being washed or carried away, as is the case when compositions are applied in a liquid carrier by padding or emersion in a bath. Thus, the application of foamed compositions minimizes the waste of excess composition and the generation of hazardous or otherwise harmful waste water or other carrier waste.

An example of a foam application is the treatment of a traveling textile substrate with dye, size, softeners, resins and other agents.

Usually, when it is intended that the applied composition impregnate the substrate, the applicator applies the foam composition under pressure and at a location where the substrate is free or unsupported on the side of the substrate opposite the foam applicator. Substrates that are generally dimensionally stable, such as woven textiles, can be treated in this manner. However, substrates that have a tendency to be dimensionally unstable, such as knitted textiles, non-wovens, elastic fabric, and other somewhat uncontrollable substrates, have not been capable of having foamed compositions applied over an uncontrolled path of the substrate between supports because of the tendency of such substrates to contract widthwise and/or to have edges curl inwardly in the unsupported extent of the path of travel.

SUMMARY OF THE PRESENT INVENTION

The present invention provides an apparatus and method that is capable of effectively applying a foamed composition to substrates that normally have a tendency to be dimensionally unstable and to do this efficiently and effectively.

Briefly described, the apparatus of the present invention includes a pair of closely spaced driven guide rollers over and between which the substrate is guided with sufficient roller engagement and controlled tension to minimize dimensional distortion. A foam applicator is provided with a substrate engaging foam dispensing nozzle face positioned within the space between the rollers of the pair of rollers to deflect the substrate inwardly between the rollers. The nozzle face extends in close proximity to the rollers to minimize the free extent of travel of the substrate between the rollers and the nozzle face. Thus, dimensional distortion of the substrate is minimized as it travels between the rollers and across the applicator face. In one form of the apparatus, the controlled tension is obtained by means for driving the rollers at controlled relative rates of rotation.

One of the guide rollers may be an input roller from which the substrate travels to the applicator nozzle face, and an infeed roller may be positioned closely adjacent the input roller, across which infeed roller the substrate travels onto the input roller, thereby minimizing the edge curling of the substrate. In one embodiment, the infeed roller forms a nip with the input roller through which the substrate travels to the input roller.

In a preferred form of the invention, the apparatus applies a foamed composition to a traveling substrate that is flat with first and second opposite surfaces and there are two pairs of guide rollers with the substrate being guided with one surface in contact with one of the pairs of rollers and the other surface being in contact with the other surface of the substrate. One applicator applies foam to one surface of the substrate between the rollers of one pair of rollers and another applicator applies foam to the other surface of the substrate between the rollers of the other pair of rollers. All of the rollers provide sufficient roller engagement of the substrate and are driven with controlled tension to minimize dimensional distortion.

Briefly described, the method of the present invention applies a foamed composition to a traveling substrate that has a tendency to be dimensionally unstable by arranging a pair of guide rollers in close proximity to each other, feeding the substrate for travel to and over a first roller of the pair and from the first roller to and over a second roller of the pair while maintaining sufficient roller engagement and controlled tension to minimize dimensional distortion. In practicing the method, a foam applicator having a substrate engaging foam dispensing nozzle face is positioned with the face within the space between the rollers to deflect the substrate inwardly between the rollers, while positioning the nozzle face in close proximity to the rollers to minimize the free extent of travel of the substrate between the rollers and the nozzle face, thereby minimizing dimensional distortion of the substrate as it travels between the rollers and across the applicator nozzle face.

The controlled tension may be obtained by the method of the present invention by driving the rollers at controlled relative rates of rotation, and disposing an infeed roller closely adjacent an input roller of the pair with the substrate being fed for travel between the infeed roller and the input roller and onto the input roller, thereby minimizing edge curling of the substrate. The infeed roller may be disposed to form a nip with the input roller and the substrate may be fed through the nip and onto the input roller.

In a preferred form of the method of the present invention the substrate is a flat substrate with first and second opposite surfaces and is fed for traveling with one surface over the rollers of the first pair of rollers and the other surface traveling over the rollers of a second pair of rollers. In traveling over the first set of rollers, the substrate is fed with the opposite surface engaging a first applicator nozzle face between and closely adjacent the rollers of the first pair and the opposite surface is engaged by a nozzle face of a second applicator disposed between the rollers of the second pair.

Preferably, the method includes driving the rollers of both pairs at controlled relative rates of rotation to maintain tension and to minimize dimensional distortion in the substrate as it travels over the rollers, between the rollers and across the applicator nozzle faces.

BRIEF DESCRIPTION OF THE DRAWINGS

Further features, embodiments, and advantages of the present invention will become apparent from the following detailed description with reference to the drawings, wherein.

DETAILED DESCRIPTION OF THE EMBODIMENTS OF THE PRESENT INVENTION

Figure 1:
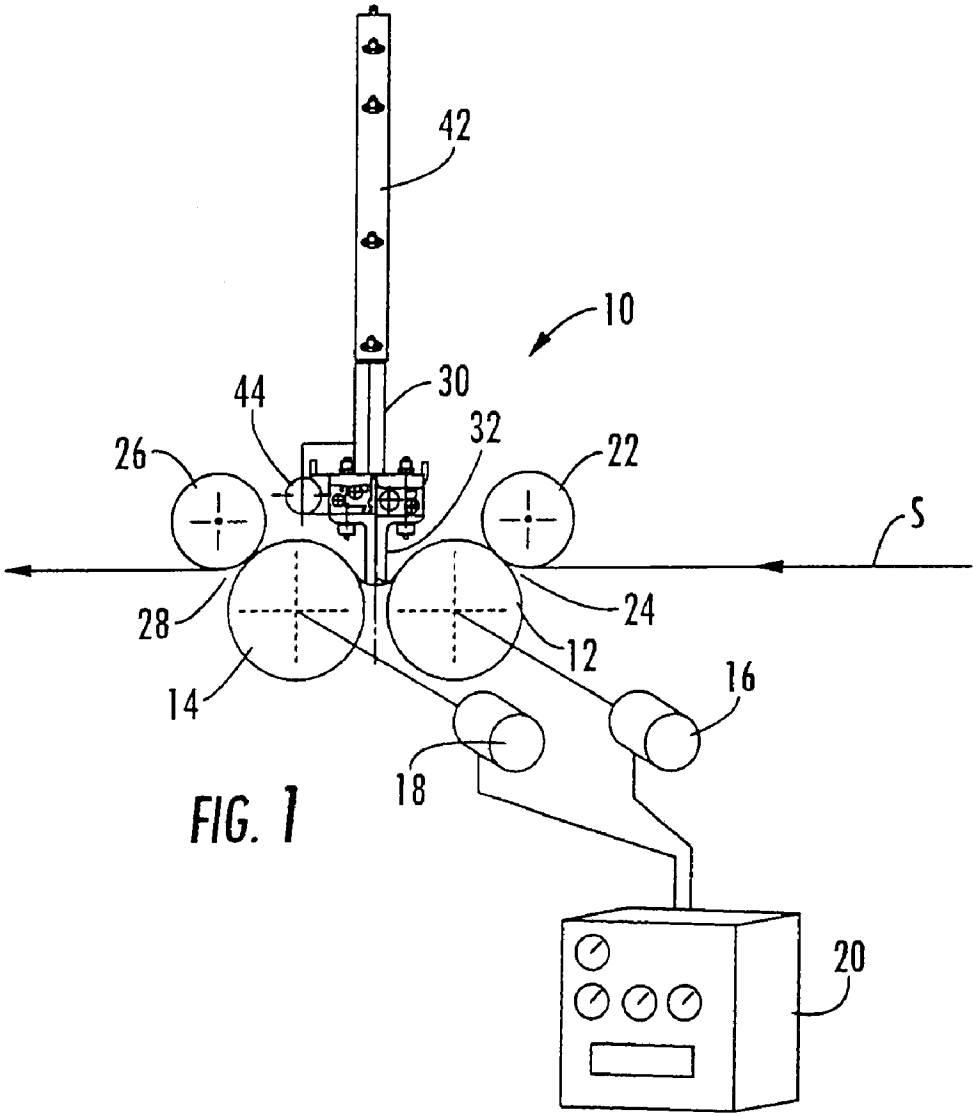
FIG. 1 is a schematic illustration of one embodiment of the apparatus for applying a foamed composition according to the present invention, which illustrated embodiment is used in practicing the method of the present invention.

FIG. 1 illustrates an example of an apparatus 10 according to the present invention for use in applying a foamed composition to a traveling substrate S that has a tendency to be dimensionally unstable. The apparatus 10 includes a pair of guide rollers 12, 14. These rollers 12, 14 are arranged at a close spacing for travel of the substrate S over the input roller 12 of the pair and across the space between rollers onto, over and from the output roller 14 of the pair. A drive motor 16 is drivingly connected to the input roller 12 and a drive motor 18 is drivingly connected to the output roller 14. The motors 16 and 18 are controlled by a conventional controller 20 that is adjustable as desired to control the relative rates of rotation of the two guide rollers 12 and 14 and, therefore, the tension of the substrate S for optimum dimensional stability. An infeed roller 22 is disposed closely adjacent the input roller 12 for guiding the substrate S onto the input roller 12 to maintain the substrate S in sufficient contact with the guide roller 12, which, in combination with the surface of the guide rollers 12, 14 being rubber coated or treated or otherwise formed with a traction surface, results in the substrate S in engagement with the surface of the input roller 12 without significant slippage. If desired, the infeed roller 22 may be positioned to form a nip 24 with the input roller 12, thereby assuring that the edges of the substrate S do not curl as the substrate S travels onto the input roller 12.

An outfeed roller 26, similar to the infeed roller 22, is positioned closely adjacent, and preferably forming a nip 28 with, the output roller 14. This outfeed roller 26 assures contact of the substrate S with the surface of the output roller 14, which is similarly covered or formed with a surface like that explained above with regard to the input roller 12, to assure travel of the substrate S with the surface of the output roller 14 without appreciable slippage.

A foam applicator 30 is disposed with a substrate engaging foam dispensing nozzle 32 having a face 34 positioned within the space 36 between the input and output rollers 12, 14. This substrate engaging foam dispensing nozzle face 36 extends sufficiently into the space 36 to deflect the substrate inwardly between the rollers 12, 14 to maintain contact with the substrate S for optimal application of foam under pressure from the nozzle face 34. The applicator 30 is adjustable in any conventional manner to obtain optimal deflection of and tension in the substrate S for optimum application of foam thereto. This tension also retains the substrate S in substantial dimensional stability. Maintenance of the substrate dimensionally stable is further enhanced by the nozzle face 36 extending in close proximity to the rollers 12 and 14, which minimizes the free extent of travel of the substrate between the rollers 12, 14 and nozzle face 34. This is illustrated more particularly in the enlargement illustration in FIG. 3, which illustrates the substrate S traveling with and over the surface of the input roller 12 into the space between the rollers, into which it travels through the space 38 unsupported to the nozzle face 34, across the nozzle face 34, and then through the unsupported space 40 to the surface of the output roller 14.

Figure 3:
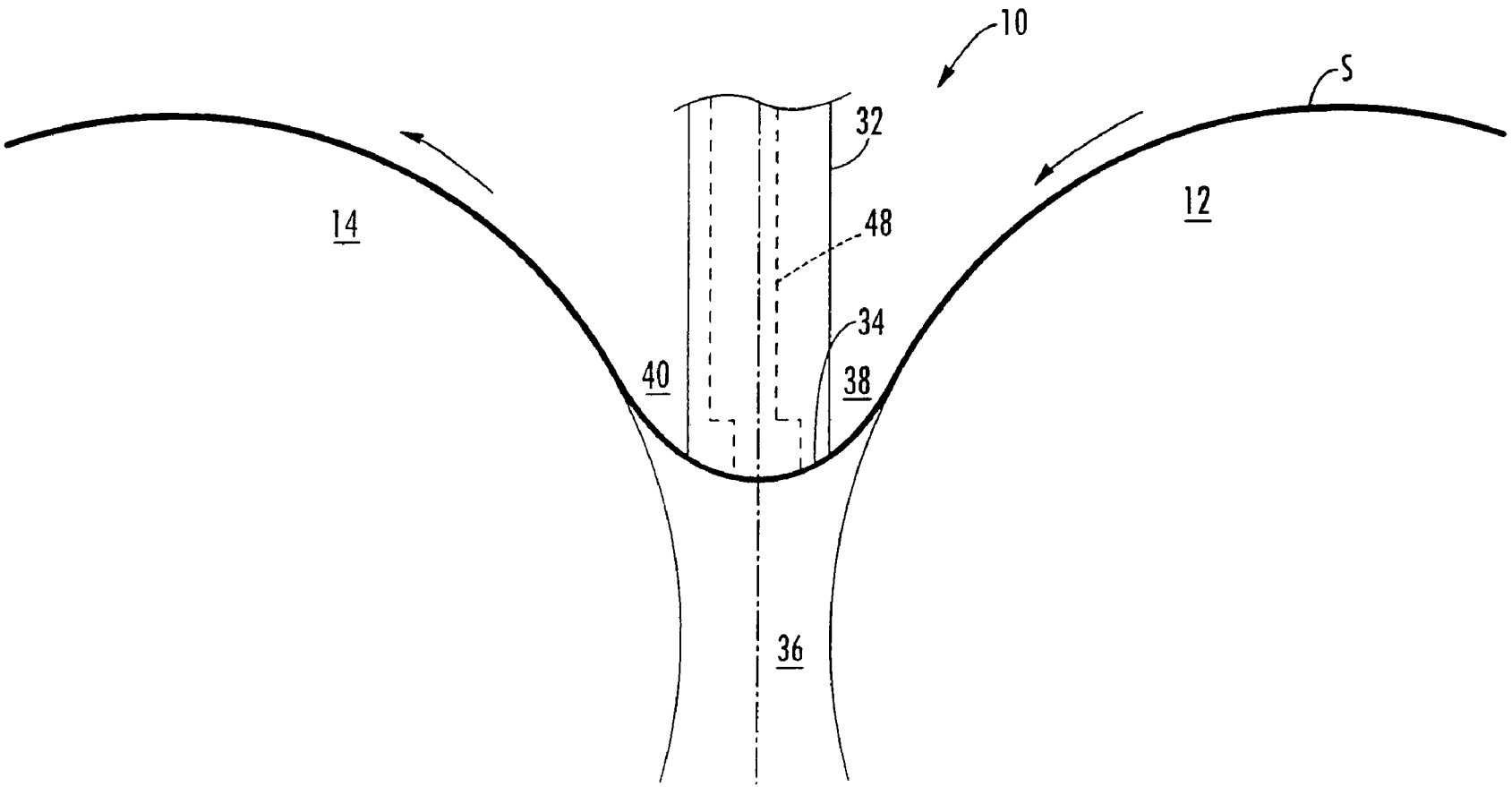
FIG. 3 is an enlarged schematic illustration of the location of a foam applicator nozzle positioned between a pair of guide rollers according to the apparatus and method illustrated in FIGS. 1 and 2.

In FIG. 3, the nozzle face 34 is illustrated as having a curvature conforming somewhat to a smooth transition of the traveling substrate S from the input roller 12 across the face 34 and onto the output roller 14. However, the nozzle face 34 may be of any desired configuration and the nozzle face 32 may be of any compatible width. If a width narrower than that illustrated in FIG. 3 is the case, the input and output rollers 12 and 14 may be closer spaced or the nozzle face 32 may be further inserted into the space 36 to maintain sufficient closeness of the nozzle to the rollers for optimum minimization of any tendency of the substrate S to contract widthwise or edge curl in the spaces 38 and 40.

In the embodiment illustrated in FIG. 1, the applicator 30 is shown having a foam distribution chamber 42 of a parabolic shape of the type disclosed in U.S. Pat. No. 4,655,056, which causes a uniform distribution of generated foam entering through the inlet 44 throughout the foam distribution chamber 42 for uniform condition through the channel 48 of the nozzle 32 and out the nozzle face 34 as the foam is being applied to the traveling substrate S.

In operation, the substrate S travels from a preceding operation in substantially flat widthwise extent to the infeed roller 22, which maintains it substantially flat and guides it into the nip 28 with the input roller 12. The input roller 12 carries the substrate on its surface as the roller rotates to the space 36, in which the substrate S travels to the applicator nozzle face 34 through the short space 38 between the input roller 12 and the nozzle face 34. The substrate S then passes across the nozzle face 34, which applies the foamed composition under pressure to the substrate S with the nozzle face 34 deflecting the substrate S in the space 36 to maintain tension on the substrate S, which is unsupported on the surface opposite the surface on which the nozzle face 34 is applying foam so that the foam under pressure will penetrate fully into the substrate S.

The substrate S with the applied foam then travels from the nozzle face 34 through the short space 40 between the nozzle face 34 and the surface of the output roller 14, which then carries the substrate S on its surface to the nip 28 with the outfeed roller 26, from which the substrate S is discharged in substantially the same dimensional condition as it entered the apparatus. It then continues through further treatment, which may, for example, include a tenter frame for controlling the dimensional condition of the substrate S.

Figure 2:
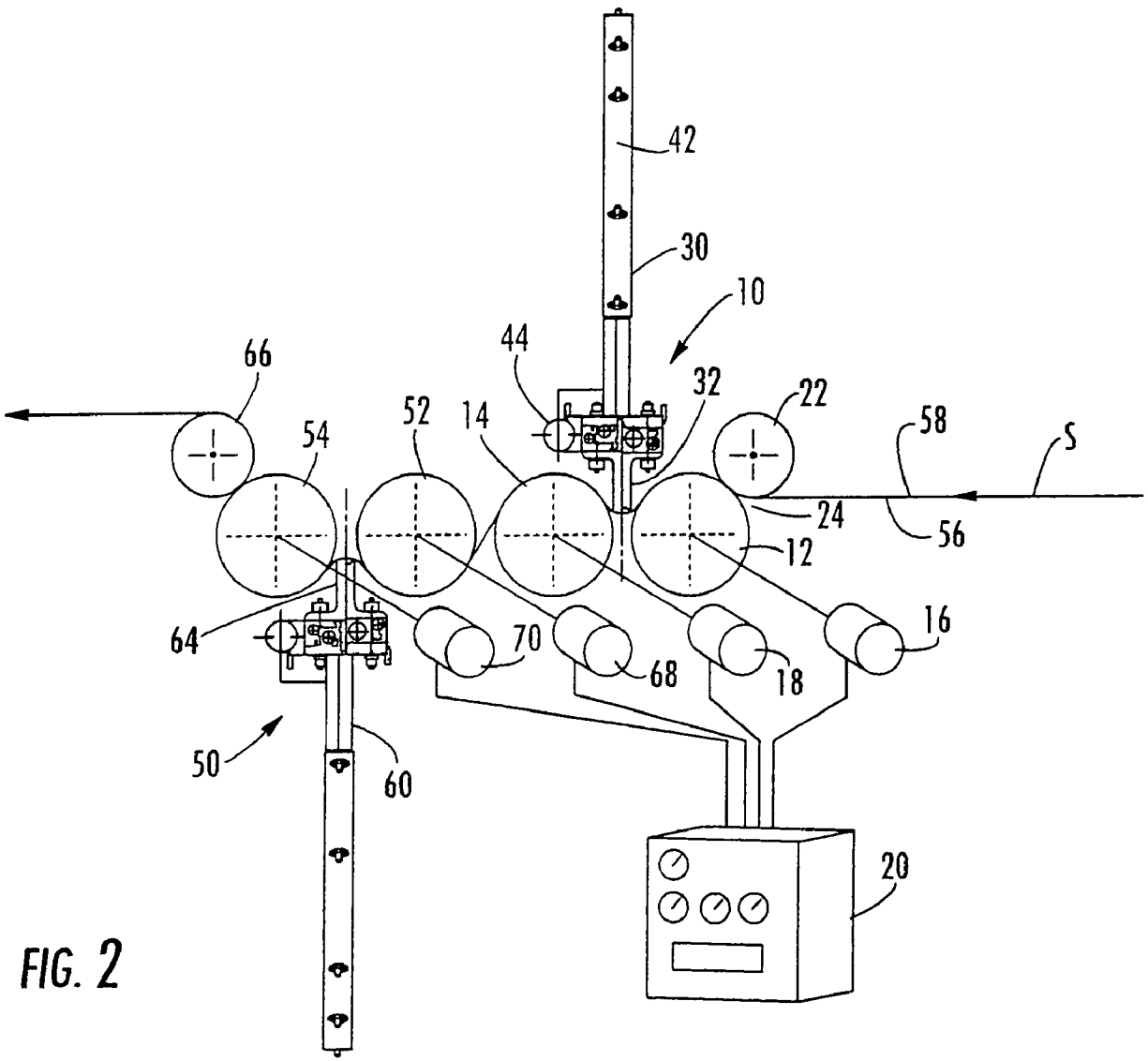
FIG. 2 is a schematic illustration of another form of the apparatus of the present invention that can be used for practicing another form of the method of the present invention.

In an alternate embodiment illustrated in FIG. 2, the apparatus 10 of FIG. 1 is combined with a similar apparatus 50 arranged for applying foam to the opposite surface of the substrate S. In this alternate embodiment, a second pair of input and output rollers 52, 54 are arranged in sequence with the pair 12 and 14 of the apparatus 10, with the input roller 52 of this second pair being closely adjacent to the output roller 14 of the first pair for travel of the substrate S from the output roller 14 of the first pair. With this arrangement, the first surface 56 of the substrate S that is in contact with the rollers 12 and 14 of the first pair, with the first applicator 30 applying foam to the opposite or second surface of the substrate S. The roller engagement is reversed on the apparatus 50 with the second surface 58 being engaged by and carried by the second pair of rollers 52, 54 with a second applicator 60 applying foam to the first surface 56 of the substrate S through the face 62 of the second nozzle 64.

With this arrangement, there is no outfeed roller 26 associated with the first pair of rollers 12, 14, but there is a second outfeed roller 66 similarly associated with the output roller 54 of the second pair of rollers. Otherwise, the second apparatus 50 is identical to the first apparatus 10 except that it is arranged oppositely for applying foam to the opposite surface of the substrate S.

Also, the operation of the second apparatus 50 is identical to the operation of the first apparatus 10, except for the application of the foam to the opposite side of the substrate S.

Further, the second pair of input and output rollers 52, 54 are driven by motors 68 and 70 controlled by the aforementioned controller 20, which is adjustable for optimum control of the relative rotation of all four guide rollers, 12, 14, 52 and 54 to obtain optimal stabilization of the dimensions of the substrate S as it passes through the first and second apparatus 10 and 50.

Figure 6:
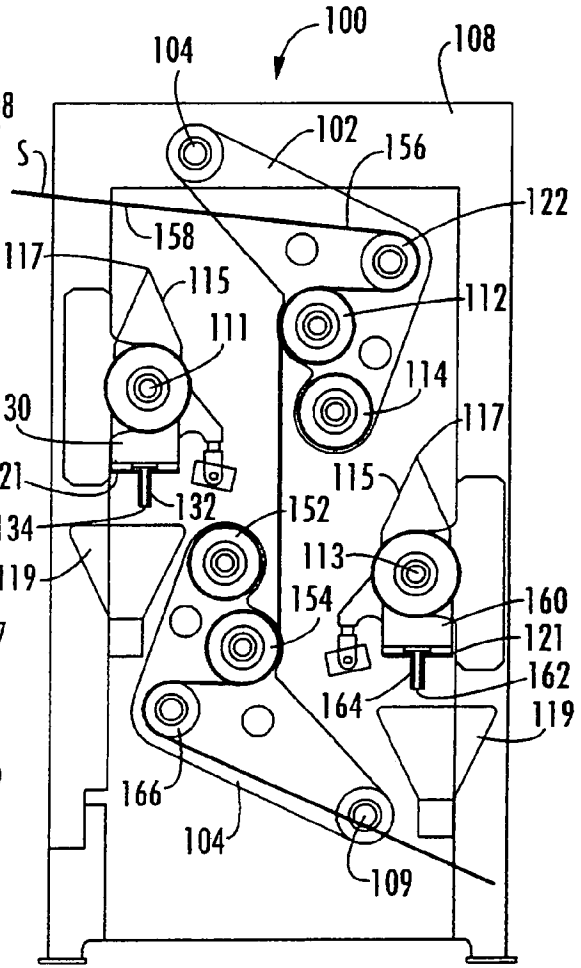
FIG. 6 is an illustration of the components of FIG. 4 shown in a position in which the applicator nozzles are disposed downwardly for draining fluid from the applicators.
Figure 5:
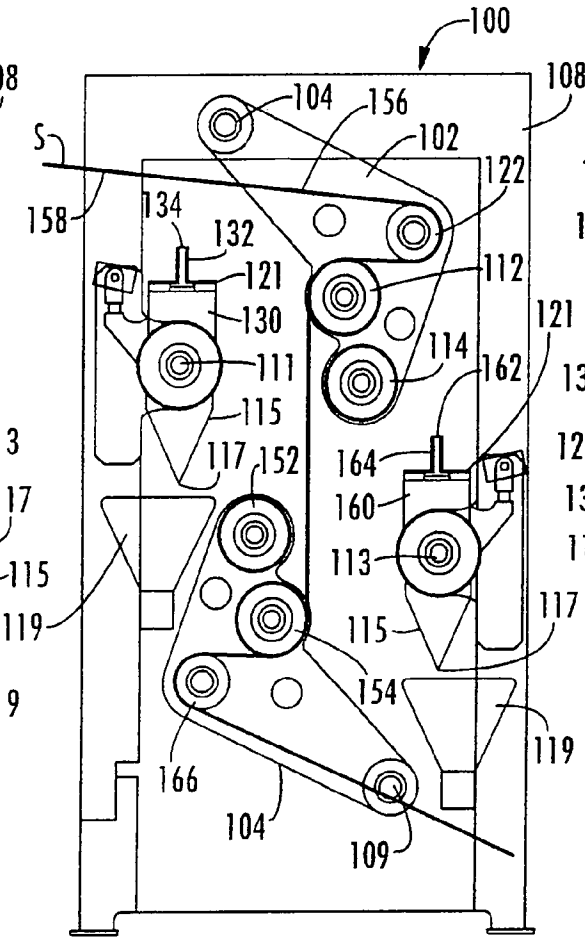
FIG. 5 is an illustration of the components of FIG. 4 shown in a position in which the applicator nozzles may have a flushing fluid circulated therethrough.
Figure 4:
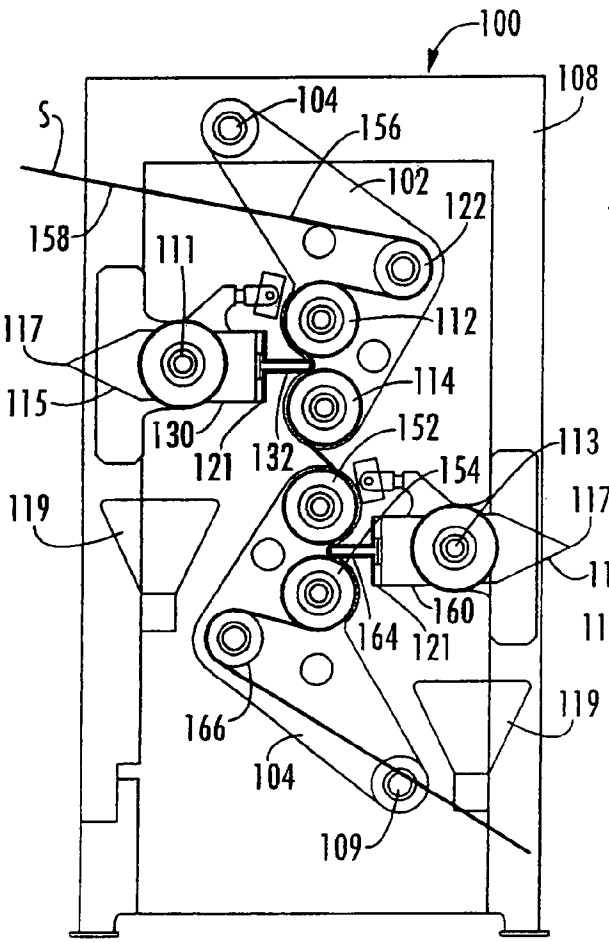
FIG. 4 is an illustration of another embodiment of the apparatus and method of the present invention, illustrating the components in position during foam application to a traveling substrate.

Another embodiment of the present invention is illustrated in FIGS. 4, 5 and 6. In this apparatus 100 the substrate S is fed in a generally vertical direction past vertically spaced and oppositely directed horizontally disposed applicators 130 and 160, with the nozzles 132 and 164 extending horizontally in contact with the opposite surfaces 156 and 158 of the substrate S.

The substrate S is guided past the nozzles by two pairs of vertically spaced guide rollers. The first or upper pair of rollers, 112 and 114 are closely spaced in vertical alignment so that the nozzle 132 of the upper applicator 130 will be positioned in the space between the rollers, with the nozzle face 134 deflecting the substrate S and with the nozzle face 134 having its edges closely adjacent the upper rollers 112 and 114 to minimize possible dimensional distortion of the substrate S. This upper nozzle 132 applies the foamed composition to the first surface 156 of the substrate S.

The second pair of guide rollers 152 and 154 is below and vertically aligned with the upper pair 112, 114, with the upper, or input roller 152 of the second pair of guide rollers being below and closely adjacent the output or lower roller 114 of the upper pair of guide rollers. The substrate S is guided with the first surface 156 in contact with the rollers 112, 114 of the first pair to the opposite or second surface 158 of the substrate S being in engagement with the guide rollers 152, 154 of the second pair of guide rollers. This results in the first surface 156 of the substrate S being positioned for contact by the second applicator 60, with the nozzle face 162 of the second applicator nozzle 164 being disposed within the space between the guide rollers 152 and 154 of the second pair and with the edges of the applicator nozzle face 162 being closely adjacent the guide rollers 152 and 154 to minimize the free travel space for the substrate S, thereby minimizing the potential for dimensional instability of the substrate S.

Each of the guide rollers 112, 114, 152 and 154 of the two pairs of guide rollers are independently driven at controlled rotational speeds through individual motors and a controller in the same manner as described above with regard to the embodiment of FIG. 2.

To guide the travel of the substrate S to the input roller 112 of the first pair of rollers and to provide sufficient extent of contact therewith for positive travel of the substrate S on the surface of the input guide roller 112, an infeed roller 112 is mounted above and to the side opposite the first applicator 130.

Similarly, an outfeed roller 166 is disposed below the output roller 154 of the second pair of rollers and to the side of that roller opposite the second applicator nozzle 164 for guiding of the substrate S from the output roller 154 of the second pair of guide rollers around the outfeed roller 166 from which the substrate S travels away from the apparatus 100.

In the embodiment of FIGS. 4, 5 and 6, the applicators, 130 and 160 are pivotable from the foamed composition applying positions illustrated in FIG. 4, in which position the applicator nozzles 132 and 164 are in horizontal dispositions as illustrated in FIG. 4, to a disposition in which the nozzles 132 and 164 are positioned vertically upward for flushing of the foamed composition from the applicators 130 and 160 as illustrated in FIG. 5, and to a draining position in which the nozzles 132 and 164 are positioned vertically downwardly.

To accommodate this pivoting of the applicators, 130 and 160, the pairs of guide rollers, 112, 114, 152 and 154 are mounted on pivotable brackets 102, 104. The upper pair of guide rollers 112, 114 and the infeed roller 122 are mounted on one bracket 102, which is an upper bracket. This upper bracket 102 is pivotally mounted on a rotatable shaft 106 that is pivotally secured to the frame 108 of the apparatus 100 above the upper pair of guide rollers 112, 114. This upper shaft 106 accommodates rotation of the upper bracket 102 in a conventional manner for pivoting the upper bracket and the guide rollers 112 and 114 and the infeed roller 122 mounted thereon sufficiently away from the upper applicator 130 to permit the aforementioned rotation of the applicator. When the applicator 130 is again positioned for applying foamed composition to the substrate S, the bracket 102 can be rotated reversely to reposition the upper bracket 102 and the guide rollers 112 and 114 of the upper pair of guide rollers and the infeed roller 122 for resumption of the application of the foamed composition to the substrate S from the upper applicator 130.

Similarly, the second or lower pair of rollers, 152 and 154 and the outfeed roller 166 are mounted on the lower bracket 104, which is mounted on a lower pivot shaft 109 disposed below the rollers for pivoting of the lower bracket 104 to move the lower or second pair of rollers 152, 154 away from the second applicator nozzle 164 to permit pivoting of the second applicator 160 into the flushing position of FIG. 5 where the nozzle 164 is pointed vertically into the draining position illustrated in FIG. 6, where the nozzle 164 is pointing downwardly. This bracket pivoting is accomplished by a conventional drive mechanism to pivot the lower bracket 104 toward and away from the second applicator nozzle 164.

To provide for the pivoting of the first and second applicators 130 and 160, each is mounted on a horizontal shaft 111 and 113 respectively. The applicators 130 and 160 and their respective shafts 111 and 113 are mounted to the frame 108. The applicators 130 and 160 are rotated in a conventional manner on the shafts 111 and 113 between the operating position indicated in FIG. 4, where the nozzles 132 and 164 extend horizontally for application of the foamed composition onto the traveling substrate S, to the position indicated in FIG. 5, where the nozzles 132 and 164 are positioned to extend vertically upwardly. In this position, the foamed composition is flushed from the applicators 130 and 160 by forcing a flushing fluid through the applicators and out of the nozzle faces 134 and 162. The foamed composition and flushing fluid are discharged from the upwardly facing applicator nozzle faces 134 and 162, from which they flow downwardly over the exterior of the applicators 130 and 160 and across a triangularly shaped drain panel that tends to cause the flow along the triangular shape to the lower point 117, from which the material flows into a drain trough 119 that extends below the applicators.

From the flushing position illustrated in FIG. 5, the applicators 130 and 160 are manipulated by pivoting to the position indicated in FIG. 6 where the nozzles 132 and 164 extend vertically downwardly above the troughs 119. In this position the flushing liquid that is in the applicators 130 and 160 drains from the applicators into the troughs 119.

The foamed composition can be distributed to the applicator nozzles 132 and 164 in any desired manner. In the embodiment illustrated in FIGS. 4, 5 and 6, an incremental parabolic distributor, such as that illustrated and disclosed in U.S. Pat. No. 6,814,806 and indicated generally by the reference numeral 121 can be used to obtain equal pressure and flow of the foamed composition from the nozzle faces 134 and 162.

In operation of the embodiment illustrated in FIGS. 4, 5 and 6, the substrate S is threaded around the rollers when the rollers are in the position illustrated in FIG. 5. That is, the substrate S is wrapped around the infeed roller 122, over the input roller 112 of the upper pair of rollers, down around the output roller 54 of the lower pair of rollers, and around the outfeed roller 166. With the applicators 130 and 160 positioned with their nozzles 132 and 164 extending horizontally, as in FIG. 4, the brackets 102 and 104 are rotated toward the applicators to position the rollers and applicator nozzles in the positions illustrated in FIG. 4. In this position, the foamed composition is discharged from the nozzle faces 134 and 162 under pressure onto the adjacent surface of the substrate S.

When an application run has been completed, the applicators 130 and 160 are rotated on the shafts 111 and 113 to position the applicator nozzles 132 and 164 to extend vertically upwardly, as indicated in FIG. 5. In this position, flushing fluid is directed through the applicators 130 and 160 for flow out of the nozzle faces 134 and 162. When adequate flushing has been accomplished, flow of the flushing fluid is stopped and the flushing fluid remains in the applicators 130 and 160 to prevent any undesired drying of material in the applicators.

Before resuming an applicating run, the applicators 130 and 160 are rotated to the draining position illustrated in FIG. 6, wherein the nozzles 132 and 164 extend vertically downwardly to allow the material in the nozzles to drain into the drain troughs 119. The applicators 130 and 160 are then rotated into the applicating position in FIG. 4 and the brackets 102 and 104 are rotated into the applicating position illustrated in FIG. 4, with the nozzle faces 134 and 162 positioned in the spaces between the rollers in the manner illustrated in FIG. 3.

When the applicating run has been completed, the roller supporting brackets 102 and 104 are pivoted to move the rollers out of contact or interference with the applicator nozzles 132 and 164, the applicators 130 and 160 are rotated to the position illustrated in FIG. 5, with the nozzles 132 and 164 disposed vertically upwardly. Flushing fluid is then flowed through the applicators 130 and 160 until the foamed composition has been fully flushed. Flow of the flushing fluid is then discontinued with the flushing fluid remaining in the nozzles until the next application of the foamed composition to a substrate S, before which the applicators 130 and 160 are pivoted to the drain position illustrated in FIG. 6, with the nozzles 132 and 164 extending vertically downwardly for drainage of the flushing fluid from the applicators 130 and 160 in readiness for manipulating the components into the applicator position indicated in FIG. 4 and the resumption of flow of foamed composition through the applicators 130 and 160 onto the traveling substrate S.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. Apparatus for applying a foamed composition to a traveling substrate that has a tendency to be dimensionally unstable, comprising:

a pair of closely spaced driven guide rollers over and between which the substrate is guided with sufficient roller engagement and controlled tension to minimize dimensional distortion;

a foam applicator having a substrate engaging foam dispensing nozzle face positioned within the space between said rollers to deflect the substrate inwardly between the rollers, said face extending in close proximity to said rollers to minimize the free extent of travel of the substrate between said rollers and said nozzle face, thereby minimizing dimensional distortion of the substrate as it travels between said rollers and across said applicator face; and said substrate is flat with first and second opposite surfaces, said pair of guide rollers is a first pair of guide rollers over which the first surface of the substrate is guided and said foam applicator is a first applicator for applying foam to the second surface of the substrate, a second pair of closely spaced driven guide rollers to which the substrate travels from said first pair of guide rollers and over which the second surface of the substrate is guided with sufficient roller engagement and controlled tension to minimize dimensional distortion, and a second foam applicator having a substrate engaging foam dispensing nozzle face facing the first surface of the substrate and positioned within the space between said rollers of said second pair to deflect the substrate inwardly between the rollers, said face of said second foam applicator extending in close proximity to said rollers of said second pair of rollers to minimize the free extent of travel of the substrate between said second pair of rollers and said nozzle face of said second applicator, thereby minimizing dimensional distortion of the substrate as it travels between said rollers of said second pair and across said applicator face of said second applicator.

2. The apparatus for applying a foamed composition to a traveling substrate according to claim 1 characterized further by means for driving said rollers of said first and second pairs at controlled relative rates of rotation to maintain tension and to minimize dimensional distortion in the substrate as it travels over said rollers, between said rollers and across said applicator nozzle faces.

3. The apparatus for applying a foamed composition to a traveling substrate according to claim 1 characterized further by one of said rollers of said first pair of guide rollers being an input roller from which the substrate travels to said nozzle face of said first applicator and the other roller of said first pair of guide rollers being an output roller to which the substrate travels from said applicator nozzle face of said first applicator, and an infeed roller closely adjacent said input roller across which infeed roller the substrate travels onto said input roller, thereby minimizing edge curling of the substrate.

4. The apparatus for applying a foamed composition to a traveling substrate according to claim 3 characterized in that said infeed roller forms a nip with said input roller, through which nip the substrate travels from said infeed roller onto said input roller.

5. The apparatus for applying a foamed composition to a traveling substrate according to claim 3 characterized in that each said first and second pair of guide rollers comprises an input roller and an output roller, said input roller of said second pair of rollers being closely adjacent said output roller of said first pair of rollers to minimize the free extent of travel of the substrate between said pairs of rollers, thereby minimizing dimensional distortion of the substrate as it travels from said output roller of said first pair of rollers to said input roller of said second pair of rollers.

* * * * *